US005860049A

United States Patent [19]

Kumasaka et al.

[11] Patent Number: 5,860,049

[45] Date of Patent: Jan. 12, 1999

[54] DEVELOPING APPARATUS AND PICTURE IMAGE FORMING APPARATUS

[75] Inventors: Takao Kumasaka, Takahagi; Tatsuo Igawa, Kitaibaraki; Shigetaka Fujiwara, Hitachi; Nobuyoshi Hoshi, Hitachinaka, all of Japan

[73] Assignee: Hitachi, Ltd., Tokyo, Japan

[21] Appl. No.: 863,125

[22] Filed: May 27, 1997

[30] Foreign Application Priority Data

Jun. 5, 1996 [JP] Japan ..... 8-142796

[51] Int. Cl.[6] ..... G03G 13/09

[52] U.S. Cl. ..... 399/267; 399/275; 399/277

[58] Field of Search ..... 399/267, 270, 399/272, 274, 275, 277, 273

[56] References Cited

U.S. PATENT DOCUMENTS

| | | | |
|---|---|---|---|
| 3,939,801 | 2/1976 | Tanaka et al. | 399/234 |
| 4,030,447 | 6/1977 | Takahashi et al. | 399/264 |
| 4,078,929 | 3/1978 | Gundlach . | |
| 4,833,505 | 5/1989 | Furuya et al. | 399/231 |
| 5,442,425 | 8/1995 | Yokoyama et al. | 399/276 |
| 5,491,541 | 2/1996 | Yokoyama et al. | 399/277 |
| 5,634,183 | 5/1997 | Saito et al. | 399/227 |

FOREIGN PATENT DOCUMENTS

| | | |
|---|---|---|
| 48-57637 | 8/1973 | Japan . |
| 55-101969 | 8/1980 | Japan . |
| 60-168177 | 8/1985 | Japan . |
| 3-109582 | 5/1991 | Japan . |
| 3-291680 | 12/1991 | Japan . |
| 4-338781 | 11/1992 | Japan . |
| 6-149058 | 5/1994 | Japan . |

*Primary Examiner*—Matthew S. Smith
*Attorney, Agent, or Firm*—Anotnelli, Terry, Stout & Kraus, LLP

[57] ABSTRACT

By employing a developer using ferrite system carriers, a developing process can be carried out using a low brushing force by a magnetic portion having the same polarity in a developing unit in a developing roller. A relationship between a circumferential speed Up (mm/sec) of a photoconductor, a ratio K of a circumferential speed of a developing sleeve of the developing roller to the circumferential speed of the photoconductor, and a developing potential difference ΔV (V) is set to $1.5 \leqq (K \times \Delta V/Up) \leqq 2.1$.

7 Claims, 4 Drawing Sheets

DEVELOPING APPARATUS AND PICTURE IMAGE FORMING APPARATUS

BACKGROUND OF THE INVENTION

The present invention relates to a developing apparatus and a picture image forming apparatus; and, more particularly, the invention relates to a developing apparatus for use in an electrophotography apparatus, such as a copying machine, a printing machine and a facsimile apparatus. The present invention also relates to a picture image forming apparatus for forming a two-color image using the developing apparatus.

The general principle of operation of a picture image forming apparatus will be explained. First of all, an example of a tri-level two-color picture image forming apparatus will be explained with reference to FIG. 7 and FIG. 8.

The tri-level two-color picture image forming apparatus, or the tri-level xerographic apparatus for forming a two-color picture image, comprises mainly a charging means 11 and an exposing means 25. The charging means 11 applies a charge uniformly to a surface of a photoconductor 1, which charging means is arranged opposite to an outer peripheral surface of the photoconductor 1. The exposing means 25 generates an exposing light beam 14, which exposes one region with weak intensity or half power to form a positive latent image and another region with strong intensity or full power to form a negative latent image, in response to a picture image signal having a first color signal component and a second color signal component.

An electrostatic latent image having a tri-level distribution (see FIG. 8, wherein a region L1=Vo, a region L2=Vr, and the remaining region=Vw) is formed on the outer peripheral surface of the photoconductor 1 by the charging means 11 and the exposing means 25.

The tri-level two-color picture image forming apparatus comprises a developing apparatus 12 for forming the first color and a developing apparatus 13 for forming the second color. Both the developing apparatus 12 and the developing apparatus 13 employ a different charge polarity of toner with respect to each other. By using the developing apparatus 12, a high potential portion (Vo=the region L1) is developed through a normal development process where the toners are charged with a reverse polarity with respect to the charging polarity of the photoconductor 1.

Further, by using the developing apparatus 13, a low potential portion (Vr=the region L2) is developed through a reverse development process where the toners are charged with the same polarity as the charging polarity of the photoconductor 1. In this way, a two-color toner image is formed on the surface of the photoconductor 1. The recharging of the photoconductor 1 is performed through a pre-transfer charging means 24, so that the polarity of the toner image is made equal to either the positive polarity or the negative polarity.

The toner image now charged with one polarity is transferred onto a paper sheet 15 through a transferring means 23, and the toners are thermally fused on the paper sheet 15 through a fixing means 17, after which the toners are fixed on the paper sheet 15. Thus, with one rotation of the photoconductor 1, a printing process to produce a two-color picture image is carried out.

The above stated two-color developing method has been proposed in, for example, Japanese patent laid-open publication No. 48-57637 and U.S. Pat. No. 4,078,929. The use of a pre-transfer charging means 24 for recharging the toners to either the positive polarity or the negative polarity, for example, has been proposed in Japanese patent laid-open publication No. 48-53727.

Further, in the operation of the developing apparatus, various processes have been proposed. For example, FIG. 6 shows a conventional developing apparatus 2 where two-component developer mixed carriers with toners are used. In this developing apparatus 2, a developing roller 5 is arranged opposite to an outer peripheral surface of a photoconductor 1 with a developing gap provided therebetween. The developing roller 5 is constituted by a columnar form magnet body 4 which is arranged inside of a rotating developing sleeve 3.

Plural magnetic poles S, N, S, N, . . . are magnetized at an outer peripheral portion of the magnet body 4, and a developer 7, formed of a mixture of toners with carriers, is attracted according to the magnetic force of the magnet body 4, so that a magnetic brush is formed by the developer 7 held on an outer peripheral surface of the developing sleeve 3. By causing the developer 7 to contact the surface of the photoconductor 1, an electrostatic latent image on the surface of the photoconductor 1 is developed, whereby a toner image is formed.

The developer 7 is transported in the direction of the arrow, with the counter-clockwise rotation of the developing sleeve 3 to a developing zone, while the amount of the developer 7 carried on the developing sleeve 3 is regulated by passing the developer 7 through a regulating gap formed between a regulating plate 6 and the developing sleeve 3.

In the developing zone arranged between the developing roller 5 and the photoconductor 1, the magnetic brush is formed along the magnetic lines of force formed through the magnetized pole plates 8 having, for example, the same polarity, so as to constitute adjacent double magnetic pole units having the same polarity.

In the developing zone, as already indicated, the magnetic brush is formed along the magnetic lines of force produced by adjacent magnetic poles having the same polarity. With respect to this magnetic brush, in the center portion of the double magnetic poles having the same polarity, the developer 7 can easily move to the surface of the photoconductor 1 because the constriction for the developer 7 produced by the magnetic lines of force becomes weak. Accordingly, it is possible to increase the developing density.

The above described developing unit which uses the same polarity method, for example, has been proposed in Japanese patent laid-open publication No. 55-101969, Japanese patent laid-open publication No. 3-291680, and Japanese patent laid-open publication No. 4-338781. Further, a method for applying a bias voltage comprised of an AC bias voltage and a DC bias voltage has been proposed in, for example, Japanese patent laid-open publication No. 60-168177, and Japanese patent laid-open publication No. 3-109582.

In the above stated conventional tri-level picture image forming apparatus, as shown in FIG. 8, the charging potential Vo is divided into two levels relative to the intermediate potential Vw, so that a first color electrostatic latent image and then a second color electrostatic latent image are formed with similar potential differences at an upper portion and a lower portion.

Accordingly, the potential difference between the developing bias potentials Vb1 and Vb2 of each of the first color and the second color and the latent image potential, namely, the first developing potential difference ΔV1 and the second developing potential difference ΔV2, becomes small. As a result, it has been difficult to obtain a high picture image density.

Further, in a pre-stage of the first color developing apparatus 12, the first color electrostatic latent image and the second color electrostatic latent image are formed at the same time by the exposing light beam 14. Accordingly, in the first color developing apparatus 12, steps must be taken when developing the first color electrostatic latent image to not disturb the second color electrostatic latent image.

However, in the second color developing apparatus 13, during the second color developing process, there is a tendency to disturb the first color toner image. The first color image has been formed on the outer peripheral surface of the photoconductor 1 when the magnetic brush brushes the photoconductor 1 with the developer 7, which is held on the developing sleeve 3.

Further, in the conventional developing apparatus 2 employing the same polarity system, there are no proposals for obtaining preferable conditions with respect to the constituting condition between the developer 7 and the magnetic pole units having the same polarity, with respect to the brushing force against the photoconductor 1 during the developing process, and with respect to the developing characteristics.

SUMMARY OF THE INVENTION

A first object of the present invention is to provide a developing apparatus wherein, in a same polarity magnetic pole developing system, the brushing force against a photoconductor during the developing process can be lessened to the utmost, so that a high picture image density can be obtained.

A second object of the present invention is to provide a tri-level picture image forming apparatus wherein, by using the above stated developing apparatus, without producing a disturbance of the electrostatic latent image formed on the photoconductor and without producing a disturbance of the toner image, and under the condition of a low developing potential difference, a clear printing of a two-color picture image having a high picture image density can be carried out.

In a developing apparatus according to the present invention, a two-component developer is used, in which a kind of ferrite carrier system having a saturation magnetization of 30–100 emu/g is mixed with the toners. A first magnetic pole plate and a second magnetic pole plate having the same polarity are adjacently arranged with respect to a developing zone formed by a developing roller.

Double magnetic pole units having the same polarity are constituted on a magnet body and have an angle θs between the first magnetic force peak and the second magnetic force peak which is 20°–40°, and the magnetic force Bo of the trough portion formed between the first magnetic force peak and the second magnetic force peak is set to less than 400 gauss.

In the above developing apparatus, the relationship between the circumferential speed Up (mm/sec) of the photoconductor, the ratio K of the circumferential speed of the developing sleeve and the circumferential speed of the photoconductor, and the potential difference (the developing potential difference) ΔV (V) between the potential of the electrostatic latent image and the potential of the developing bias is set to $1.5 \leqq (K \times \Delta V/Up) \leqq 2.1$.

Further, in a tri-level picture image forming apparatus in which a tri-level electrostatic latent image is formed and a two-color tri-level toner image is formed using positive toners and negative toners, the above stated developing apparatus is used as a developing apparatus for the first color.

In the second color developing apparatus in the tri-level picture image forming apparatus, the ratio K2 of the circumferential speed of the developing sleeve and the circumferential speed of the photoconductor is set to $1.0 \leqq K2 < 1.0 + (110/Up)$.

Further, the construction of the developing unit comprised of the developer and the developing apparatus is set to obtain a small brushing force against the photoconductor according to the developer and also to obtain a high developing density characteristic during the developing time.

In the tri-level picture image forming apparatus, the circumferential speed ratio K between the circumferential speed of the developing sleeve and the circumferential speed of the photoconductor is set under conditions where the picture image density can be secured, further in the second color developing apparatus, the range of the circumferential speed ratio K2 is limited so as to not disturb the toner image for the first color.

Therefore, in the tri-level picture image forming apparatus according to the present invention, in which there is no disturbance of the electrostatic latent image formed on the photoconductor and no disturbance of the toner image, while operating under a low developing potential difference, since printing having the high picture image density can be carried out, it is possible to perform a clean two-color printing.

DESCRIPTION OF THE PREFERRED EMBODIMENTS

Hereinafter, various embodiments of a developing apparatus and a picture image forming apparatus according to the present invention will be explained with reference to the drawings.

(1) First Embodiment

Figure 1:
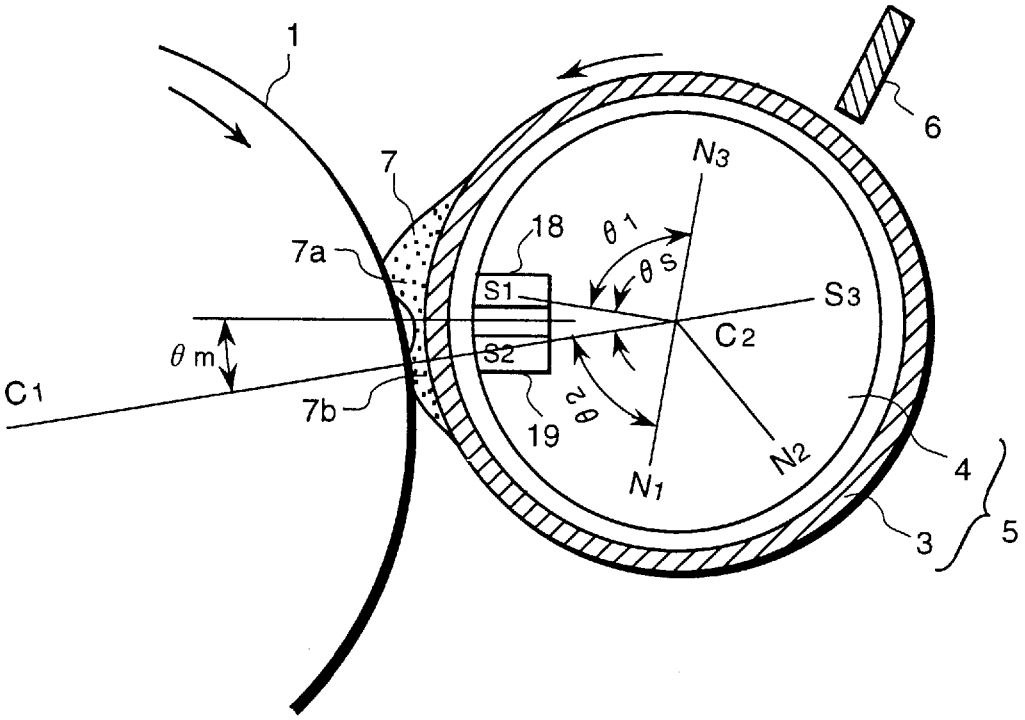
FIG. 1 is a cross-sectional side view showing a first embodiment of an essential part of a developing apparatus according to the present invention.

In a first embodiment of a developing apparatus, as shown in FIG. 1, according to the present invention, a developing roller 5 has an axial direction groove formed in an inner magnet body 4, which groove is arranged to oppose the outer surface of a photoconductor 1. A magnetic pole arrangement, providing spaced magnetic poles S1, S2 having the same polarity, is formed by embedding two magnet chips 18 and 19 in the groove.

The material for the magnet body 4 is normally an isotropic magnetization material, in which an N1 pole, N2 pole, S3 pole and N3 pole are formed by magnetizing a surrounding portion of the magnet body 4.

The two embedded magnet chips 18 and 19 are manufactured of an isotropic magnetization material or a rare-earth magnetization material, and these two embedded magnet chips 18 and 19, which are magnetized to provide a higher magnetic force than that of the magnet body 4, form the magnetic pole S1 and the magnetic pole S2, respectively, having the same polarity.

Both the value of a first magnetic force peak B1 and the value of a second magnetic force peak B2 in the magnetic pole arrangement in the magnet body 4, which is formed by the two embedded magnet chips 18 and 19, are set in a range of 700–1,100 gauss.

An angle θs formed between the first magnetic force peak B1 and the second magnetic force peak B2 is set in a range of 20°–40° for reasons to be stated later. To obtain the above angle θs, the gap between the two embedded magnet chips 18 and 19 and the width of the two embedded magnet chips 18 and 19 are adjusted and are set, respectively, in a range of 1–8 mm and a range of 1–5 mm in accordance with the diameter of the developing roller 5.

The developing roller 5 has a diameter of 20–50 mm, and the developing gap formed between the photoconductor 1 and the developing sleeve 3 is 0.7–1.2 mm. The regulating gap formed between the regulating plate 6 and the developing sleeve 3 is set to be narrower, such as 0.1–0.3 mm less, than the gap formed between the photoconductor 1 and the developing sleeve 3.

Further, in the magnet body 4, the magnetic force of the N1 pole, which is arranged upstream in the rotation direction of the developing sleeve 3 with respect to the second embedded magnet chip 19, and the magnetic force of the N3 pole, arranged downstream in the rotation direction of the developing sleeve 3 with respect to the first embedded magnet chip 18, are set to be substantially equal.

As the developer 7, a two-component developer of ferrite system carriers mixed with toners is employed. The ferrite system carriers (this term indicates ferrite carriers and magnetite carriers) employed have an apparent density of 2.2–2.8 g/cm$^3$, and a saturation magnetization of 30–100 emu/g, preferably a saturation magnetization of 60–90 emu/g.

In a case where the ferrite system carriers having a saturation magnetization of less than 25 emu/g and resin carriers (sphere shapes and indefinite shapes) having an apparent density of 1.0–1.6 g/cm$^3$ and a saturation magnetization of 60–80 emu/g are prepared with toners under a mixture ratio of 4–15 wt % and these mixture materials are employed, there is a tendency for the carrier to stick to the photoconductor 1.

Further, in the case of use of a ferrous powder, in the developing unit there is a tendency for the brushing force on the photoconductor 1 to be excessive, and further a problem may occur in which the minute ferrous powder particles scatter. The amount to which the toners are charged is in a range of 5–15 μc/g, preferably in a range of 6–9 μc/g.

Figure 3:
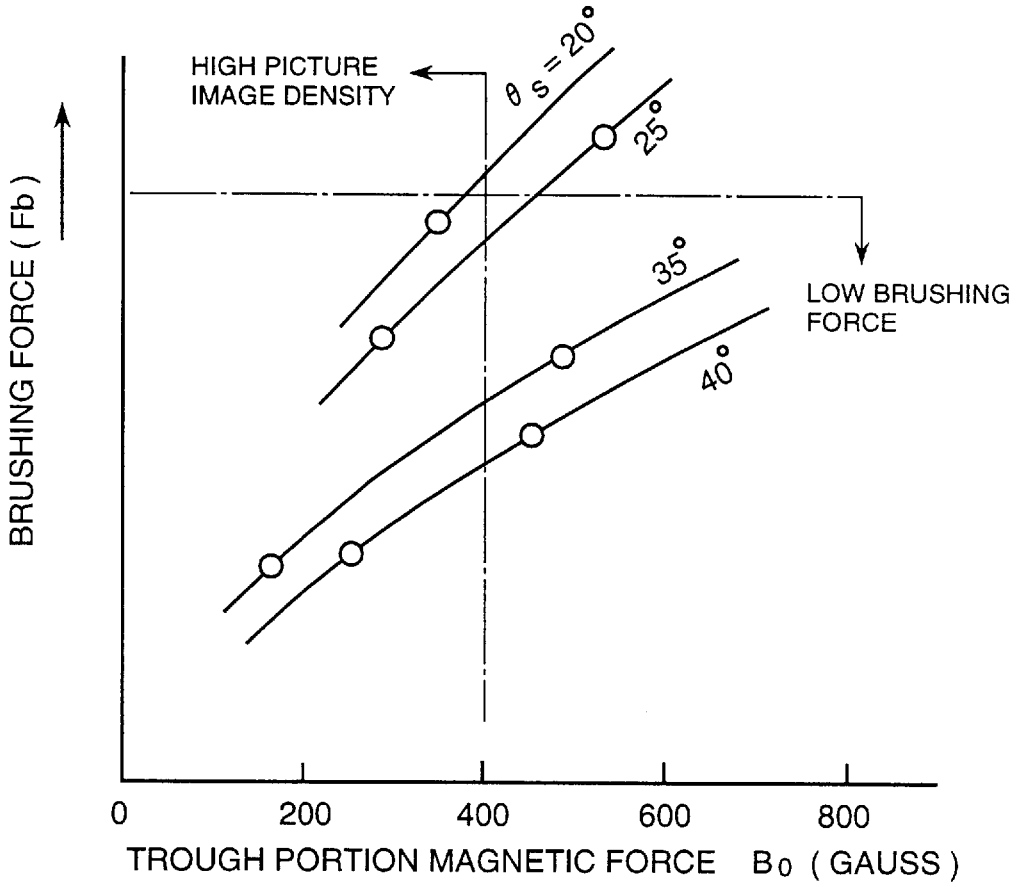
FIG. 3 is a characteristic diagram showing a relationship between the magnetic force and the brushing force in a trough portion in a magnetic pole portion having the same polarity in a developing apparatus according to the present invention.

In the developing apparatus using the above stated developer 7, the inventors have studied the relationship between the angle θs (in degrees) between the first magnetic force peak B1 and the second magnetic force peak B2 of the magnetic pole arrangement formed by the magnetic poles S1, S2 of the same polarity, the magnetic force Bo (in gauss) of the trough portion formed between the first magnetic force peak B1 and the second magnetic force peak B2, and the brushing force Fb of the magnetic brush against the photoconductor 1. As a result of this study, it has been determined, as shown in FIG. 3, that by setting the angle θs between the first magnetic force peak B1 and the second magnetic force peak B2 at 20°–40°, preferably at 25°–35°, and also by setting the magnetic force Bo of the trough portion formed between the first magnetic force peak B1 and the second magnetic force peak B2 at a small value which is at the utmost, for example, in a range of less than 400 gauss, preferably in a range of less than 300 gauss, the brushing force Fb of the magnetic brush on the photoconductor 1 was made smaller.

Further, it has been found that when the angle θs is 20°, the magnetic force Bo of the trough portion is 400 gauss as a limitation value. Further, when the angle θs is more than 40°, there is a tendency for both the value of the first magnetic force peak B1 and the value of the second magnetic force peak B2 to be lowered.

Figure 2:
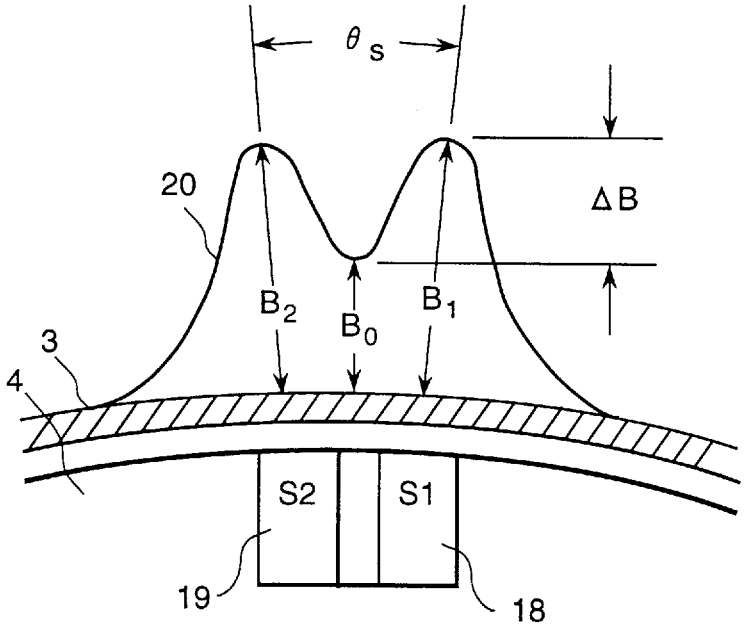
FIG. 2 is a diagrammatic view showing the magnetic field distribution of a magnetic pole portion having the same polarity in a developing apparatus according to the present invention.

Further, in the magnetic pole arrangement formed by the adjacent poles S1, S2 having the same polarity, a magnetic force distribution 20 having two crests occurs, as shown in FIG. 2. As shown in FIG. 1, a first magnetic brush 7*a* having a high bristle height and a second magnetic brush 7*b* having a low bristle height are formed, and in the vicinity of the second magnetic brush 7*b*, a kind of toner cloud is formed.

The reason for this will be explained as follows. When the developer 7 forming the magnetic brush 7*a*, which is held by the first magnetic force peak B1 produced by the first embedded magnet chip 18, moves to the trough portion having a weak magnetic force, as a result of a disturbance generated due to the lowering of the constriction force in the developer, then the toners can easily separate from the carriers and a toner cloud is formed in the vicinity of the magnetic brush 7*b*, which toner cloud is strongly held again by the second magnetic force peak B2 produced by the second embedded magnet chip 19. As a result, although the brushing force of the photoconductor 1 produced by the magnetic brush 7*b*, which is formed by the second embedded magnet chip 19, is weakened, it is possible to realize a developing having a high density.

Namely, an organic photoconductor body (OPC) is used as the photoconductor 1, and an electrostatic latent image having a charging area potential Vo of −500 V and an exposing area potential Vr of −50 V is formed on the surface of the photoconductor 1, which rotates at a circumferential speed of 270 mm/sec. The peripheral speed of the developing sleeve 3 is about 1.3–1.9 times the circumferential speed of the photoconductor 1, and a developing bias of 350 V is applied to the developing sleeve 3, so that a reversal developing process is carried out. Accordingly, a picture image density of 1.3–1.4 (O.D.; optical density) can be obtained.

Further, as shown in FIG. 1, the gap of the developing unit is set so that it is narrower than the bristle height of the second magnetic brush 7*b* having the low bristle height. Further, the magnetic pole establishment angle θm, namely the angle constituted by a line connecting a center of the magnetic poles S1 and S2 of the embedded magnet chips 18 and 19 and a center C2 of the developing roller 5 and a line C1-C2 connecting the center of the developing roller 5 and the center of the photoconductor 1, is set, as shown in FIG. 1, to θs/6 to 5×θs/6, and preferably to 2×θs/6 to 4×θs/6.

In the above case, a developing characteristic having a high density can be secured, and also the carrier adhesion to the photoconductor 1 can be reduced.

The second embedded magnet chip 19 for forming the second magnetic force peak B2 may be set substantially at a point nearer to the photoconductor 1 and the developing sleeve 3. In this case, the magnetic force of the surface portion of the photoconductor 1 in the vicinity of the second embedded magnet chip 19 is strong, and, with a strong magnetic force condition, the developer 7 is constricted. As a result, the carriers are restrained from sticking against the photoconductor 1.

Figure 4:
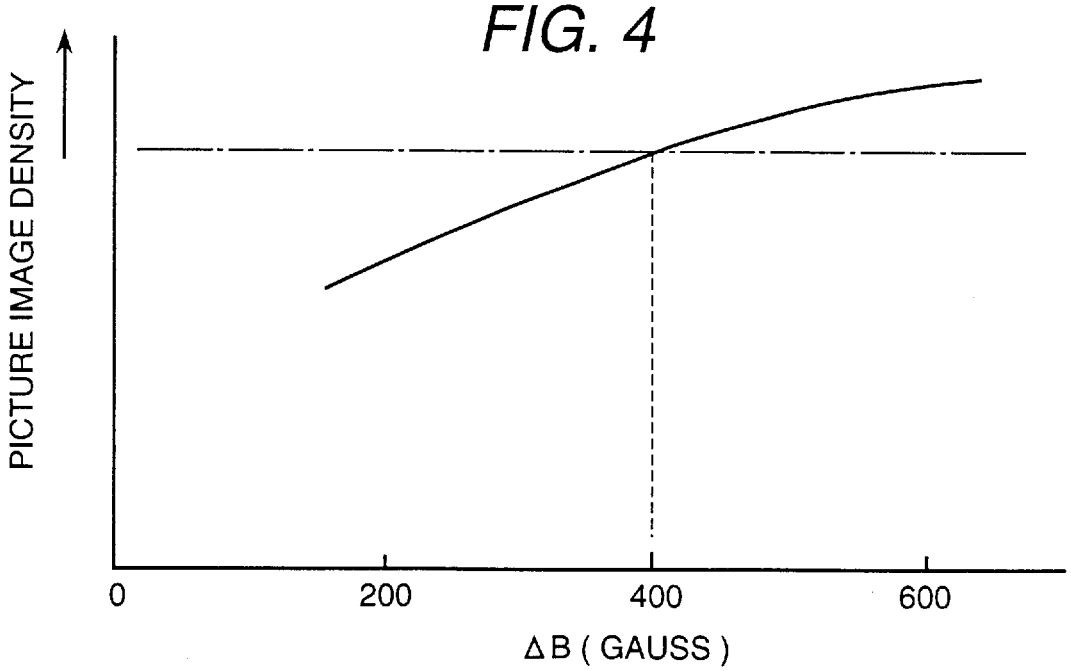
FIG. 4 is a characteristic diagram showing a relationship between the difference (ΔB) between the magnetic force of a first magnetic pole and the magnetic force in the trough portion and the picture image density in a magnetic pole portion having the same polarity in a developing apparatus according to the present invention.

Further, as shown in FIG. 4, when the difference ΔB between the first magnetic force peak B1 in the magnetic force distribution including the two crests and the magnetic force in the trough portion is in a range of 300–600 gauss, preferably 400–600 gauss, a toner image having a comparatively high density can be obtained.

In other words, the range of the high picture image density shown in FIG. 3 corresponds to the above stated results shown in FIG. 4. Accordingly, under these developing conditions, as shown in FIG. 3, the condition where the brushing force against the photoconductor 1 is small can be consistent with the condition for obtaining a comparatively high density picture image. As a result, even when the developing is carried out with a small brushing force, a high picture image density can be secured.

(2) Second Embodiment

Using the developing apparatus described in the first embodiment, the inventors of the present invention have studied the relationships among the potential difference (the developing potential difference) ΔV (V) between the potential of the electrostatic latent image and the potential of the developing sleeve 3, the circumferential speed Up (mm/sec) of the photoconductor 1, the circumferential speed ratio K between the circumferential speed of the developing sleeve 3 and the circumferential speed of the photoconductor 1, and the picture image density ID (O.D.).

Figure 5:
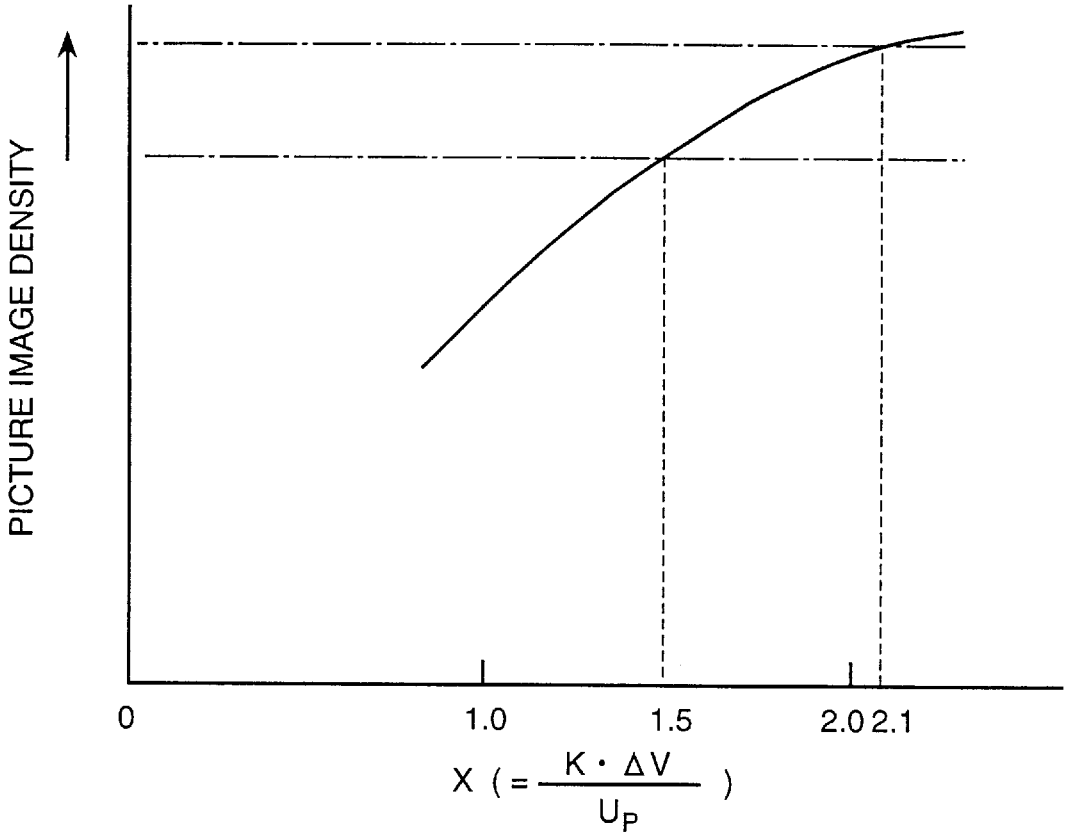
FIG. 5 is a characteristic diagram showing the picture image density according to the present invention.
Figure 6:
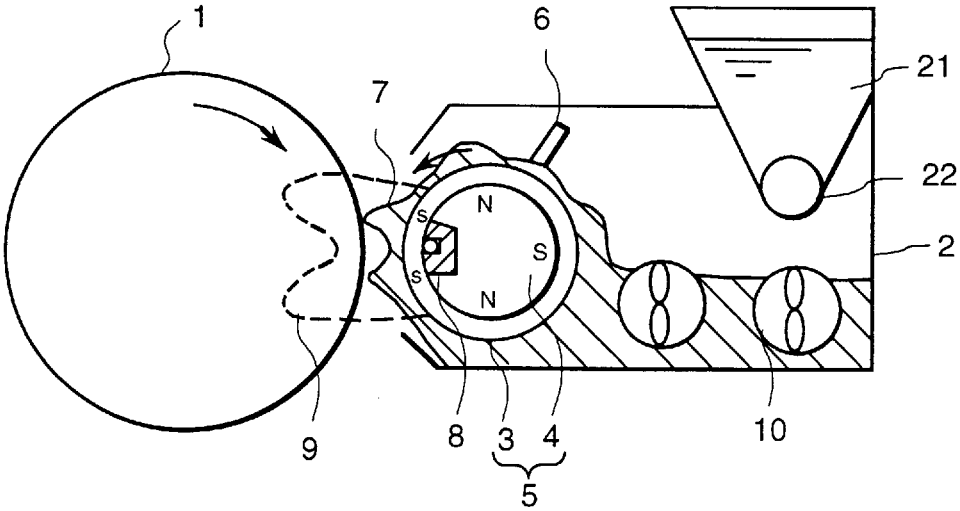
FIG. 6 ( PRIOR ART )
FIG. 6 is a cross-sectional side view showing a developing apparatus according to the prior art.

The picture image density ID is measured with respect to the various values of the circumferential speed Up, the potential difference ΔV, and the circumferential speed ratio K. However, using X=K×ΔV/Up as a parameter, and plotting data of the picture image density ID for X, it becomes clear that it is possible to approximate the picture image density ID substantially by a single curved line. Such a result is shown in FIG. 5. As can be understood from FIG. 5, when the parameter X is in a range of 1.5–2.1, a high picture image density can be obtained.

Accordingly, in the developing apparatus according to the present invention, when the circumferential speed ratio K is set in response to the circumferential speed Up and the potential difference ΔV as indicated in the following formula (1), the picture image density to be targeted can be secured.

$$1.5 \leqq (K \times \Delta V/Up) \leqq 2.1 \quad (1)$$

(3) Third Embodiment

Figure 7:
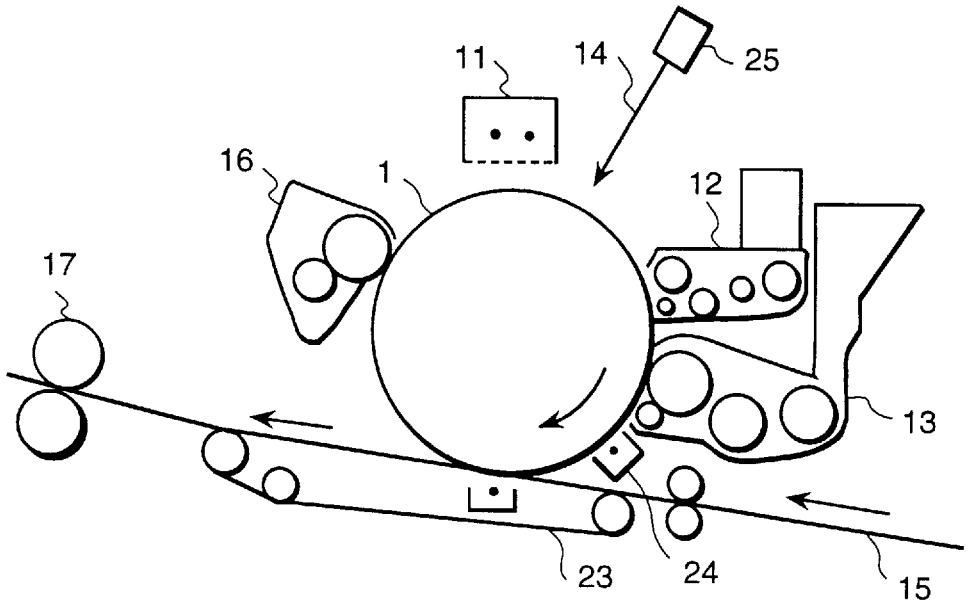
FIG. 7 is a schematic diagram showing a third embodiment and a fourth embodiment of a two-color picture image forming apparatus according to the present invention.

In a tri-level picture image forming apparatus according to the present invention, as shown in FIG. 7, a charging means 11 and an exposing means 25 are arranged adjacent to the photoconductor 1. The exposing means 25 generates an exposing light beam 14 for exposing the photoconductor 1 in one region using a weak intensity to form a positive latent image and in another region using a strong intensity to form a negative latent image in response to the first color picture image signal and the second color picture image signal, respectively.

By this exposing process using the above stated means, a tri-level electrostatic latent image can be formed. Further, by using the first developing apparatus 12 and the second developing apparatus 13, with toners which have a different color charging polarity, the high potential portion is developed according to the normal development process using toners which are charged with a reverse polarity with respect to the charging polarity of the photoconductor 1.

Further, the low potential portion is developed according to the reverse development process using toners which are charged with the same polarity as the charging polarity of the photoconductor 1. As a result, a two-color toner image is formed on the outer peripheral surface of the photoconductor 1 and the polarity of the toner image is recharged by the pre-transfer charging means 24 to have either the positive polarity or the negative polarity.

The toner image which has been charged to one polarity is transferred by the transferring means 23 onto the paper sheet 15, and, using the fixing means 17, the toner image is thermally fused on the paper sheet 15 and is fixed to the paper sheet 15, whereby two-color picture image printing is carried out in one rotation of the photoconductor 1.

Further, after the transferring process, the residual toners on the outer peripheral surface of the photoconductor 1 are cleaned through use of a cleaner 16.

As the photoconductor 1, it is suitable to use an OPC (organic photoconductor), where the photoconducting layer is of a two-layer type (layers comprised of a charge generating layer and a charge transporting layer), as well as a single layer type OPC.

As one example of the former type photoconductor, there is a negative charging OPC, which is constituted by a charge generating layer (CGL) of a carbazole hydrazine system pigment having a thickness of 0.1–1 μm and a charge transporting layer (CTL) of a phthalocyanine system pigment having a thickness of 10–20 μm, for example, the OPC made by Mitsubishi Chemical Co. As one example of the latter type photoconductor, a normal charging signal type OPC (commercial name: MARINE OPC drum), such as made by Mita Industry Co., can be used.

Further, in the negative charge two-layer type OPC, a blocking layer may be provided between an Al layer and the photoconducting layer.

Hereinafter, an example of the present invention will be explained, wherein a negative charging OPC is used as the photoconductor 1 and the circumferential speed of the photoconductor 1 is 270 mm/sec.

In the first color developing apparatus 12, a developer using ferrite system carriers is used, and the magnetic brush formed by the developer is caused to contact the photoconductor 1, whereby a first color developing process is carried out.

As the carriers for the first color developer, ferrite and magnetite carriers having a mean diameter of 60–120 μm, an apparent density of 2.2–2.8 g/cm$^3$ and a saturation magnetization of 60–100 emu/g are used. As the toners for the first color developer, color toners having a mean diameter of 7–11 μm and a charging amount of 5–11 μc/g for a mixture ratio with the carriers of 3–6 wt % are used.

The surfaces of the carriers are coated with a silicone system resin material or an acrylic system resin material, and thus a good charging property and good stability can be obtained. Further, the resistance value of the carriers is adjusted and used by adding carbon to the coating resin material. In this regard, it is desirable to use a developer having a carrier resistance value which is $10^6$–$10^9$ Ωcm and having a current value of 1–100 μA in a case where the voltage corresponding to the developing condition is applied.

By using the above stated developer, in the first color developing process, the charging of the electrostatic latent image for the first color tends to leak and the potential is lowered, as a result of which the carrier adhesion during the developing process for the second color can be restrained.

It is desirable to adjust the contact width between the first color developer and the photoconductor 1 to about 3–10 mm and the contact depth between the first color developer and the photoconductor 1 to about 0.3–1 mm.

The circumferential speed ratio K1 between the circumferential speed of the developing sleeve 3 and the circumferential speed of the photoconductor 1 in the first color developing apparatus 12 is specified from the formula (1) according to the circumferential speed Up (mm/sec) of the photoconductor 1 and the developing potential difference ΔV (V).

As to the second color developing process, a developer using ferrite system carriers is used in the second color developing apparatus 13 and the magnetic brush formed by this developer is brought into contact with the photoconductor 1, whereby a second color developing process is carried out.

As the carriers for the second color developer, ferrite system carriers having a mean diameter of 60–120 μm, an apparent density of 2.2–2.8 g/cm$^3$ and a saturation magnetization of 60–100 emu/g are used. As the toners for the second color developer, black toners having a mean diameter of 7–11 μm and a charging amount of −5 μc/g to −11 μc/g for a mixture ratio with the carriers of 3–6 wt % are used.

The circumferential speed ratio K2 between the circumferential speed of the developing sleeve 3 and the circumferential speed of the photoconductor 1 in the second color developing apparatus 13 is specified from the relationship expressed by the formula (1) according to the circumferential speed Up (mm/sec) of the photoconductor 1 and the developing potential difference ΔV (V), and furthermore it is limited to a range specified by the following formula (2):

$$1.0 \leqq K2 \leqq 1.0+(110/Up) \quad (2)$$

As to the toners of the developers for the first color and the second color, the resistance value, the fluidity property and the charging property are adjusted by adding silica and conductive particles on the surface of the toners.

Further, as to the toners for the first color developer, a mutual relationship between the first color developer and the second color developer is established to form a charging amount according to triboelectric frictional charging, with the carriers for the second color developing process having a charging amount of less than 4 μc/g; accordingly, the background fogging which tends to occur during printing of a two-color picture image can be reduced.

Further, in this third embodiment according to the present invention, the first color is a color other than white or black, and the second color is black, so even in the case where the color toners are mixed with a black color developer in the developing apparatus 13, the muddiness of the color about the black color picture image will not be noticeable.

Further, in the case of normal two-color picture image printing, there is a tendency where the ratio of the black color picture image becomes high, that during the black color picture image printing, the color toners mixed with the black color developer in the black color developing apparatus 13 can be discharged.

Therefore, since the accumulation with the lapse of time of the color toners in the black color developing apparatus 13 can be restrained, the color mixture ratio can be maintained at a low level.

Figure 8:
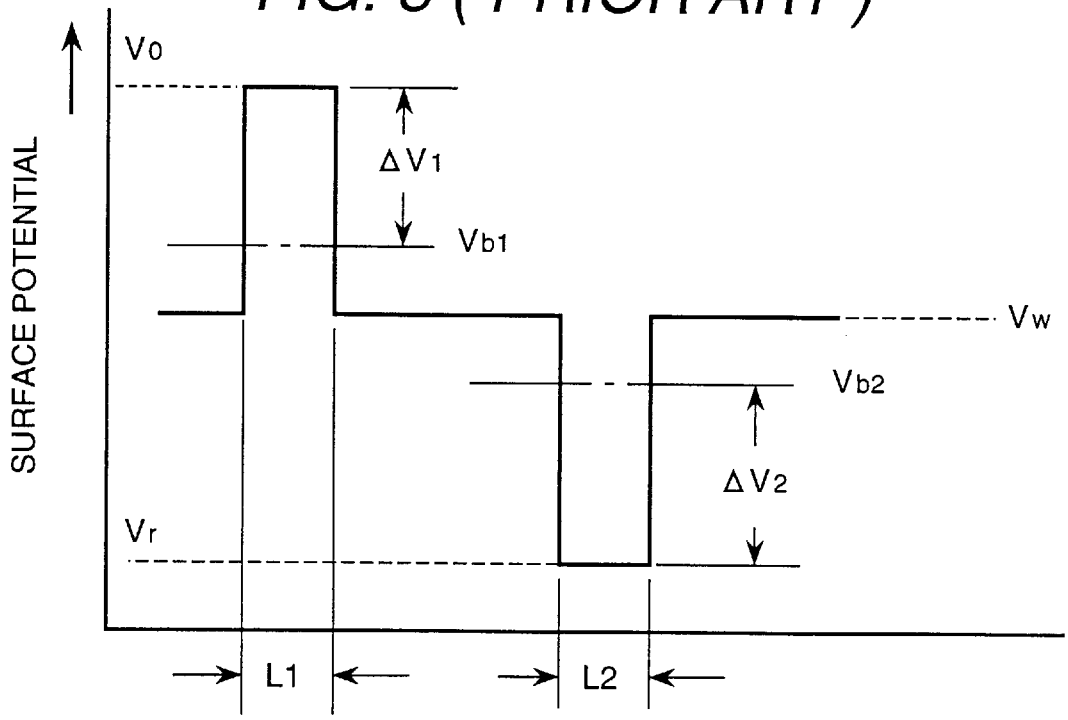
FIG. 8 ( PRIOR ART )
FIG. 8 is a diagram showing an electrostatic latent image and the developing bias potential distribution in a tri-level picture image forming apparatus.

As a result of the charging process and the exposing process, a tri-level electrostatic latent image (refer to the potential distribution shown in FIG. 8) is formed, and this tri-level electrostatic latent image has a charging area potential Vo of −850 V (the first color electrostatic latent image for the color picture image=L1) on the peripheral surface of the photoconductor 1, an exposing area potential Vr of −50 V (the second color electrostatic latent image for the black color picture image=L2) and an intermediate potential Vw of about −540 V.

As the first color developing bias Vb1, a developing bias voltage of −620 V is applied, and as the second color developing bias Vb2, a developing bias voltage of −400 V is applied. Accordingly, the first color electrostatic latent image is used to carry out a normal developing process and the second color electrostatic latent image is used to carry out the reverse developing process.

The circumferential ratio K1 of the developing sleeve 3 in the first color developing apparatus 12 is set according to the formula (1), and the circumferential ratio K2 of the developing sleeve 3 in the second color developing apparatus 13 is set according to the formula (2). In the formula (1) and the formula (2), in a case where K1=2.0 and K2=1.3, a picture image density of 1.3–1.4 (O.D.) can be secured.

Further, the toner image disturbance in the first color and the muddiness (the mixing of color) in the second color, which has a tendency to be generated during the second color developing process, can be prevented.

As stated above, in this third embodiment of the tri-level picture image forming apparatus according to the present invention, the brushing force applied against the photoconductor 1 due to the magnetic brush in the second color developing process can be made small; therefore, the disturbance of the toner image in the first color, which is formed on the outer peripheral surface of the photoconductor 1, can be restrained.

Further, the degree of scratching of the first color toner image can be made small, and so the mixing of the first color toner image into the second color developing apparatus 13 can be reduced remarkably.

Accordingly, in this third embodiment of the tri-level picture image forming apparatus according to the present invention, possible disturbance in the picture image and muddiness of color can be prevented, and as a result, a clear two-color picture image can be formed.

(4) Fourth Embodiment

A fourth embodiment of a color picture image forming apparatus according to the present invention will be explained with reference to FIG. 7.

In this fourth embodiment, two developing apparatuses 12 and 13 for receiving the developers corresponding to each of the colors are arranged around the outer peripheral surface of the photoconductor 1 and two electrostatic latent images corresponding to the respective colors are formed during one rotation or two rotations of the photoconductor 1. During the developing of these two electrostatic latent images using the two developing apparatuses 12 and 13, the two toner images are transferred together onto the paper sheet 15. Therefore, the color picture image forming process according to the present invention is performed.

In the second color developing apparatus 13, the developing apparatus described in the foregoing embodiments and the conditions for the formula (2) are applied. As the second color developer, a two-component developer in which the carriers are mixed with the toners is used, and, as the carriers, ferrite carriers having a saturation magnetization of 30–100 emu/g are used. The circumferential speed ratio of the developing sleeve is set according to the formula (1) and an OPC is used as the photoconductor 1.

As to the first color developing apparatus 12, the second color developing apparatus 13, the transferring means 23 and the cleaner 16, mechanisms for contacting and/or separating these elements relative to the photoconductor 1 are added, and a two-color toner image is formed during two rotations of the photoconductor 1. In the case of the toner image formation during the first rotation, the second color developing apparatus 13, the transferring means 23 and the cleaner 16 are separated from the outer peripheral surface of the photoconductor 1. On the other hand, in the case of the toner image formation during the second rotation, the first color developing apparatus 12 is separated from the outer peripheral surface of the photoconductor 1. As a result, the possibility of destroying the toner image on the photoconductor 1 is small.

In this fourth embodiment of the picture image forming apparatus according to the present invention, the first color is black and the second color is a color other than white or black, and the printing of a two-color picture image can be carried out using the following processes.

The circumferential speed of the photoconductor 1 is set to 178 mm/sec, and, during the first rotation, the surface potential Vo of the photoconductor 1 is uniformly charged to about −600 V using the charging means 11. The exposure for the first color is carried out by the exposing means 25, and the electrostatic latent image for the first color is formed to have a potential Vr of −50 V at the exposing area.

Next, a developing bias voltage of −400 V is applied to the developing sleeve 3 of the first color developing apparatus 12, and the reversal developing process is carried out, so that a toner image for the first color is formed. For the first color developer, ferrite system carriers similar to the second color developer are used, and a single magnetic pole developing system is used. Then, the potential of the toner image for the first color is set to −100 to −200 V.

Next, the second rotation is started, and again by charging using the charging means 11, the voltage of the toner image for the first color is increased to −350 to −400 V. At this time, the surface potential of the background portion is about −500 V. In this condition, the exposing process for the second color is carried out using the exposing means 25, and an electrostatic latent image for the second color, having a potential Vr of −50 V in the exposing area, is formed. To develop the electrostatic latent image for the second color, the range of the developing bias voltage applied to the developing sleeve 3 is −250 V to −350 V.

In a case where the developing bias potential has a higher value, background fogging will easily occur. However, in a case where the developing bias potential is lower, the reverse electric field becomes strong, and accordingly, electric scratching will easily occur in the toner image for the first color.

The developing bias potential is set to −300 V and the circumferential speed ratio K2 is set to about 1.2–1.4 in accordance with the formula (2), and thus a reverse developing process is carried out. As a result, a picture image density for the second color of 1.3–1.4 (O.D.) can be obtained.

Further, in the second color developing process, the brushing force of the magnetic brush against the photoconductor 1 is made small, and the degree of scratching of the toner image for the first color is made small. Accordingly, the mixing of the first color toners into the second color developing apparatus 13 can be reduced remarkably. Accordingly, the disturbance and the muddiness of the color in the toner image for the first color can be prevented, and as a result, a clean two-color picture image can be obtained.

As stated above, in the fourth embodiment of the color picture image forming apparatus according to the present invention, during two rotations of the photoconductor 1, a two-color toner image can be formed.

According to the present invention, in a process where the developer (the magnetic brush) held by the first magnetic pole at the upstream side of the developing roller moves to the second magnetic pole at the downstream side, a toner cloud in the vicinity of the second magnetic pole is formed by a disturbance which occurs between the adjacent magnetic poles having the same polarity. Accordingly, even when the magnetic brush of the developer only slightly contacts the photoconductor, and the developing is carried out with a weak brushing force, it is possible to obtain a high picture image density.

Further, using the tri-level system, a two-color toner image is formed on the surface of the photoconductor, and when the printing of a color picture image is carried out, the above stated developing apparatus is used. Accordingly, high densities for the first color and for the second color can be obtained. Further, since the process for the first color at the former stage can be carried out without disturbance of the toner image, the developing of the second color at the latter stage can be carried out, and as a result, a clean two-color picture image can be formed.

We claim:

1. A developing apparatus comprising:

a photoconductor on which an electrostatic latent image is formed;

a rotating developing sleeve arranged in opposing relationship to said photoconductor with a developing gap being provided therebetween;

a magnet body fixedly arranged in said developing sleeve;

a first magnetic pole element and a second magnetic pole element adjacently arranged in spaced relationship on said magnet body so as to face said developing gap and having same polarity for forming a first magnetic force peak and a second magnetic force peak in said developing gap;

a developer of mixed carriers and toners, responsive to a developing bias applied to said developing sleeve, so as to form a magnetic brush of developer on an outer peripheral surface of said developing sleeve for brushing developer against said photoconductor, whereby said electrostatic latent image on said photoconductor is developed, wherein said carriers are ferrite system carriers;

an angle θs formed between said first magnetic force peak and said second magnetic force peak produced by said first and second magnetic pole elements having same polarity is 20°–40°, and a magnetic force of a trough portion formed between said first magnetic force peak and said second magnetic force peak is set to less than 400 gausses;

wherein said developing gap is 0.7–1.2 mm.

2. A developing apparatus according to claim 1, wherein a regulating plate is arranged opposite to said developing sleeve for regulating an amount of developer carried on said developing sleeve into said developing gap; and wherein a regulating gap formed between said regulating plate and said developing sleeve is formed to be narrower by 0.1–0.3 mm than said developing gap.

3. A developing apparatus comprising:

a photoconductor on which an electrostatic latent image is formed;

a rotating developing sleeve arranged in opposing relationship to said photoconductor with a developing gap being provided therebetween;

a magnet body fixedly arranged in said developing sleeve;

a first magnetic pole element and a second magnetic pole element adjacently arranged in spaced relationship on said magnet body so as to face said developing gap and having same polarity for forming a first magnetic force peak and a second magnetic force peak in said developing gap;

a developer of mixed carriers and toners, responsive to a developing bias applied to said developing sleeve, so as to form a magnetic brush of developer on an outer peripheral surface of said developing sleeve for brushing developer against said photoconductor, whereby said electrostatic latent image on said photoconductor is developed, wherein said carriers are ferrite system carriers;

an angle θs formed between said first magnetic force peak and said second magnetic force peak produced by said first and second magnetic pole elements having same polarity is 20°–40°, and a magnetic force of a trough portion formed between said first magnetic force peak and said second magnetic force peak is set to less than 400 gausses;

wherein a relationship between a circumferential speed Up (mm/sec) of said photoconductor, a ratio K of a circumferential speed of said developing sleeve to the circumferential speed of said photoconductor, and a potential difference ΔV (V) between a potential of said electrostatic latent image and a potential of a developing bias is set to $1.5 \leqq (K \times \Delta V/Up) \leqq 2.1$.

4. A picture image forming apparatus in which a tri-level electrostatic latent image formed on a photoconductor by one exposing means is developed by using one developing apparatus in which toners are charged at a positive polarity and by another developing apparatus in which different color toners are charged at a negative polarity, whereby a two-color toner image is formed;

wherein as a developing apparatus for forming a toner image for a first color, a developing apparatus according to any one of claims 1–3 is used.

5. A developing apparatus comprising:

a photoconductor on which an electrostatic latent image is formed;

a rotating developing sleeve arranged in opposing relationship to said photoconductor with a developing gap being provided therebetween;

a magnet body fixedly arranged in said developing sleeve;

a first magnetic pole element and a second magnetic pole element adjacently arranged in spaced relationship on said magnet body so as to face said developing gap and having same polarity for forming a first magnetic force peak and a second magnetic force peak in said developing gap;

a developer of mixed carriers and toners, responsive to a developing bias applied to said developing sleeve, so as to form a magnetic brush of developer on an outer peripheral surface of said developing sleeve for brushing developer against said photoconductor, whereby said electrostatic latent image on said photoconductor is developed, wherein said carriers are ferrite system carriers;

an angle θs formed between said first magnetic force peak and said second magnetic force peak produced by said first and second magnetic pole elements having same polarity is 20°–40°, and a magnetic force of a trough portion formed between said first magnetic force peak and said second magnetic force peak is set to less than 400 gausses;

wherein a relationship between a circumferential speed Up (mm/sec) of said photoconductor and a ratio K of a circumferential speed of said developing sleeve to the circumferential speed of said photoconductor is set to $1.0 \leqq K \leqq 1.0 + (110/Up)$.

6. A picture image forming apparatus in which a tri-level electrostatic latent image formed on a photoconductor by one exposing means is developed by using one developing apparatus in which toners are charged at a positive polarity and by another developing apparatus in which different color toners are charged at a negative polarity, whereby a two-color toner image is formed;

wherein as a developing apparatus for forming a toner image for a second color, a developing apparatus according to any one of claims 1–2 and 5 is used.

7. A picture image forming apparatus in which a tri-level electrostatic latent image formed on a photoconductor by one exposing means is developed by using one developing apparatus in which toners are charged at a positive polarity and by another developing apparatus in which different color toners are charged at a negative polarity, whereby a two-color toner image is formed;

wherein as a developing apparatus for forming a toner image for a first color, a developing apparatus according to any one of claims 1–3 is used; and wherein as a developing apparatus for forming a toner image for a second color, a developing apparatus according to any one of claims 1–2 and 5 is used.

* * * * *